US011833701B2

(12) United States Patent
Huesman et al.

(10) Patent No.: US 11,833,701 B2
(45) Date of Patent: Dec. 5, 2023

(54) BLADE RECEIVER ASSEMBLY AND CUTTING DEVICE

(71) Applicant: Fiskars Finland Oy Ab, Helsinki (FI)

(72) Inventors: Alexander J. Huesman, Middleton, WI (US); Stephen P. Dechant, Waunakee, WI (US); Daniel Lipscomb, Prairie du Sac, WI (US)

(73) Assignee: Fiskars Finland Oy Ab, Helsinki (FI)

( * ) Notice: Subject to any disclaimer, the term of this patent is extended or adjusted under 35 U.S.C. 154(b) by 0 days.

(21) Appl. No.: 17/245,244

(22) Filed: Apr. 30, 2021

(65) Prior Publication Data

US 2022/0347877 A1 Nov. 3, 2022

(51) Int. Cl.
*B26B 25/00* (2006.01)

(52) U.S. Cl.
CPC ..... *B26B 25/005* (2013.01)

(58) Field of Classification Search
CPC ..... B26B 25/00; B26B 25/005; F16B 5/0266; F16B 37/12
USPC ..... 30/292, 306, 307, 319
See application file for complete search history.

(56) References Cited

U.S. PATENT DOCUMENTS 307,665 A * 11/1884 Long ..... B27B 5/32 83/698.41
1,286,799 A * 12/1918 Schuler et al. ..... B27B 5/32 83/666
1,459,683 A * 6/1923 Norris ..... B27B 5/32 301/2
1,727,747 A * 9/1929 Carney ..... A21C 11/106 30/306
2,920,389 A * 1/1960 Nurmi ..... A21C 11/10 30/307
3,783,729 A * 1/1974 Parr ..... B27B 5/32 451/342
4,020,550 A * 5/1977 Okada ..... B26B 25/005 30/124
4,062,116 A * 12/1977 Arnott ..... B26D 3/10 30/292
4,195,542 A * 4/1980 Zimmer ..... B26D 7/2621 83/698.21
4,408,396 A 10/1983 Scholl
4,575,937 A * 3/1986 McCullough ..... B26B 25/002 30/276
4,601,103 A * 7/1986 Sugiyama ..... B26B 25/005 30/162
RE32,501 E * 9/1987 Okada ..... B26B 25/005 30/292

(Continued)

OTHER PUBLICATIONS

Extended European Search Report for EP Application No. 22170716.9, dated Oct. 10, 2022, 7 pages.

*Primary Examiner* — Sean M Michalski
*Assistant Examiner* — Richard D Crosby, Jr.
(74) *Attorney, Agent, or Firm* — FOLEY & LARDNER LLP

(57) ABSTRACT

The invention relates to a blade receiver assembly, comprising a switch comprising a switch cover and a switch base fixedly connected to each other, wherein the switch base has an opening; an axle with a structural section and a body receiver section, wherein the axle is arranged to move through the opening of the switch base in relation to the switch. The invention also relates to a cutting device comprising a blade receiver assembly.

20 Claims, 2 Drawing Sheets

(56) References Cited

U.S. PATENT DOCUMENTS 4,730,952 A * 3/1988 Wiley ..... B27B 5/32 403/348
5,299,355 A * 4/1994 Boda ..... B26B 5/003 30/162
5,355,588 A * 10/1994 Brandenburg, Jr. .... B26B 29/02 30/292
5,447,086 A * 9/1995 Wittmaier ..... B26D 7/2621 83/676
5,480,031 A * 1/1996 Maultasch ..... B65D 85/36 206/525
5,765,289 A * 6/1998 Schulz ..... B26B 25/005 30/292
6,279,919 B1 * 8/2001 Turos ..... B23B 5/02 82/112
6,282,794 B1 * 9/2001 Cho ..... B26B 29/02 30/151
6,327,783 B1 * 12/2001 Ming ..... B26B 25/005 30/286
6,438,850 B2 * 8/2002 Young ..... B26B 25/005 30/162
6,460,254 B1 * 10/2002 Mori ..... B26B 29/02 30/286
6,484,405 B1 * 11/2002 Martelli ..... B26B 25/005 30/292
6,502,313 B1 * 1/2003 Bilodeau ..... B26B 25/005 30/292
6,554,291 B2 * 4/2003 Turos ..... B23B 5/02 409/141
6,560,873 B1 * 5/2003 Ortner ..... B26B 5/00 30/2
6,675,689 B2 * 1/2004 Nunez ..... B26B 29/06 30/151
6,851,192 B2 * 2/2005 So ..... A21C 11/106 30/299
7,216,432 B2 * 5/2007 Poteet ..... B25G 1/102 16/422
7,363,710 B2 * 4/2008 Kortleven ..... B26B 11/00 30/143
7,415,915 B2 * 8/2008 Parrish ..... B26D 7/2621 30/162
7,444,749 B1 * 11/2008 Chen ..... B26B 25/005 30/317
8,046,922 B2 * 11/2011 Eby ..... B26B 29/02 30/151
9,278,459 B2 * 3/2016 Block ..... B26D 1/205
10,315,317 B2 * 6/2019 Votolato ..... B26B 5/00
10,807,262 B1 * 10/2020 Willmoth ..... B26B 25/005
10,940,599 B2 * 3/2021 Reyes ..... B26B 29/02
2001/0029671 A1 * 10/2001 Young ..... B26B 25/005 30/162
2004/0093734 A1 * 5/2004 Votolato ..... B26B 5/00 30/2
2004/0187318 A1 * 9/2004 Mathieu ..... B26B 29/00 30/319
2005/0086811 A1 * 4/2005 Kawasaki ..... B26B 29/00 30/162
2005/0217114 A1 * 10/2005 Votolato ..... B26B 29/02 30/2
2006/0236551 A1 * 10/2006 Chang ..... B26B 25/005 30/319
2007/0022615 A1 * 2/2007 Tsai-Lian ..... B26B 25/005 30/319
2007/0028461 A1 * 2/2007 Chen Lin ..... B26B 25/005 30/293
2007/0028738 A1 * 2/2007 Chan ..... B26D 7/2621 83/485
2008/0010839 A1 * 1/2008 Eby ..... B26B 25/005 30/319
2009/0183378 A1 * 7/2009 Eby ..... B26B 25/005 30/391
2010/0037787 A1 * 2/2010 Eide ..... B26B 25/005 99/538
2011/0192034 A1 * 8/2011 Holcomb ..... B26B 25/005 30/138
2012/0011726 A1 * 1/2012 Lu ..... B26B 29/00 30/138
2017/0341251 A1 * 11/2017 Siciliano ..... B25G 3/30
2018/0160691 A1 * 6/2018 Grinaski ..... F16K 1/12

* cited by examiner

BLADE RECEIVER ASSEMBLY AND CUTTING DEVICE

TECHNICAL FIELD

The disclosure relates to a blade receiver assembly and a cutting device with a rotary blade, and more particularly to a rotary blade replacement system of the cutting device.

BACKGROUND

Cutting device with a rotary blade, also known as rotary cutter, are widely used for cutting crafting materials, and especially cutting fabrics and papers. When the rotary blade become too dull, it is almost impossible to sharpen without a proper sharpener and therefore, needs to be replaced.

In the known solutions, replacing the blade requires the user to hold the blade between fingers. However, even a dull rotary blade can still be very sharp for skin tissue and cut the skin if not handled carefully.

SUMMARY

It is thus an object of the present invention to provide a blade receiver assembly and a cutting device to minimalize the risk of accidently cutting oneself. An object is particularly to introduce a solution by which one or more of the above identified problems of prior art and/or problems discussed or implied elsewhere in the description can be solved.

The invention is based on the idea of a rotary blade replacement system, which releases and attaches the rotary blade without the user needing to touch the blade at all. With this solution, one or more of the above-mentioned objects can be achieved.

One embodiment relates to a new blade receiver assembly comprising a switch, the switch comprising a switch cover and a switch base fixedly connected to each other, wherein the switch base has an opening. The blade receiver assembly further comprises an axle with a structural section and a body receiver section, wherein the axle is arranged to move through the opening of the switch base in relation to the switch.

Another embodiment relates to a cutting device comprising a body comprising a handle and a blade assembly holding member. The cutting device further comprises a blade receiver assembly with a switch comprising a switch cover and a switch base fixedly connected to each other, wherein the switch base has an opening; a spring-loaded axle with a structural section and a body receiver section, wherein the axle is arranged to move through the opening of the switch base, and the body receiver section is releasably connected to the blade assembly holding member.

DETAILED DESCRIPTION

Figure 1:
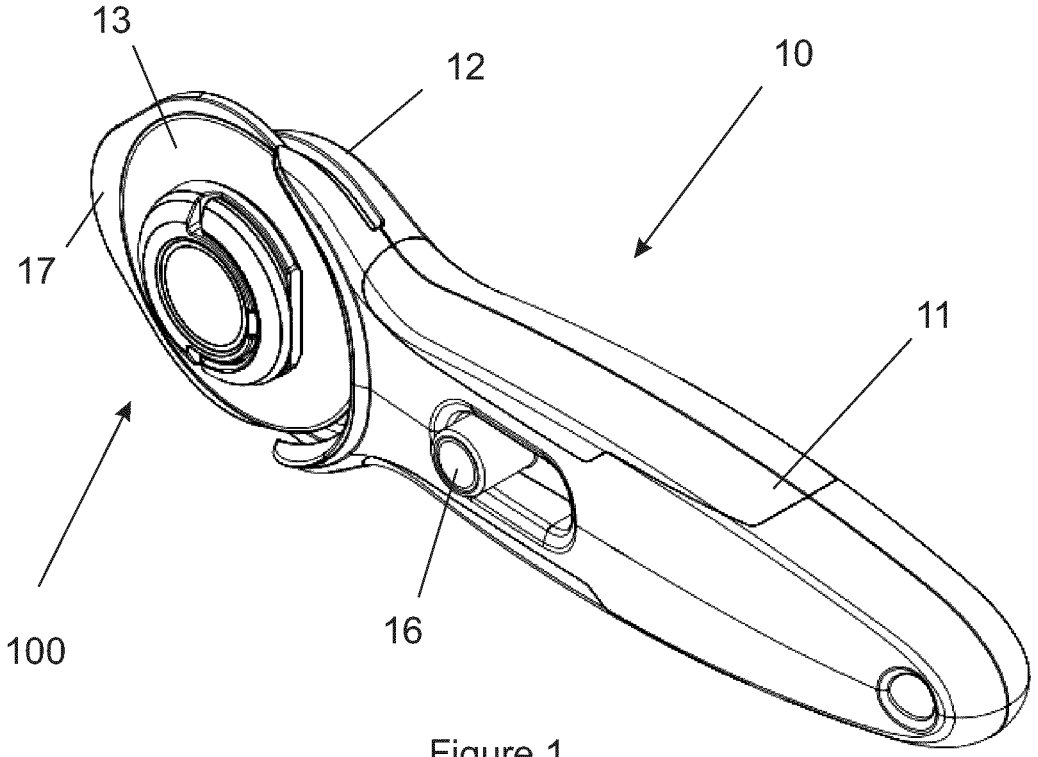
FIG. 1 illustrates a side view of a rotary cutter according to an embodiment.

Referring to FIG. 1, which illustrates a hand-held cutting device. The cutting device comprises a body 10 comprising a handle 11 and a blade assembly holding member 12. A rotary blade replacement assembly 100 is releasably connected to the blade assembly holding member 12. The handle 11 may have a contoured form and grip portions to facilitate manual gripping of the cutting device. The blade assembly holding member 12 functions to provide a holding place for a rotary blade 13 when the rotary blade 13 and the rotary blade replacement assembly 100 are engaged with the blade assembly holding member 12. The cutting device will be configured and dimensioned for rotary blades of various sizes and types. The rotary blade replacement assembly 100 can be mounted on either side of the body 10 for ambidexterity.

The cutting device may further comprise a slide member 16 connected to a slide base to move a blade guard 17. The blade guard 17 gives an additional security for the user to prevent accidently being cut by the rotary blade 13.

The blade may be any rotary blade 13 with a perforated hole 14 in the middle. The blade may be a straight, wave, scallop, or pinking blade. The rotary blades are usually sold in a cartridge or a case, which may have more than one blade for a replacement. The package may hold two cartridges: one for dull blades and another for spare blades. The rotary blade 13 can be made of a ferromagnetic material, such as iron, steel, nickel, cobalt, etc.

Figure 2:
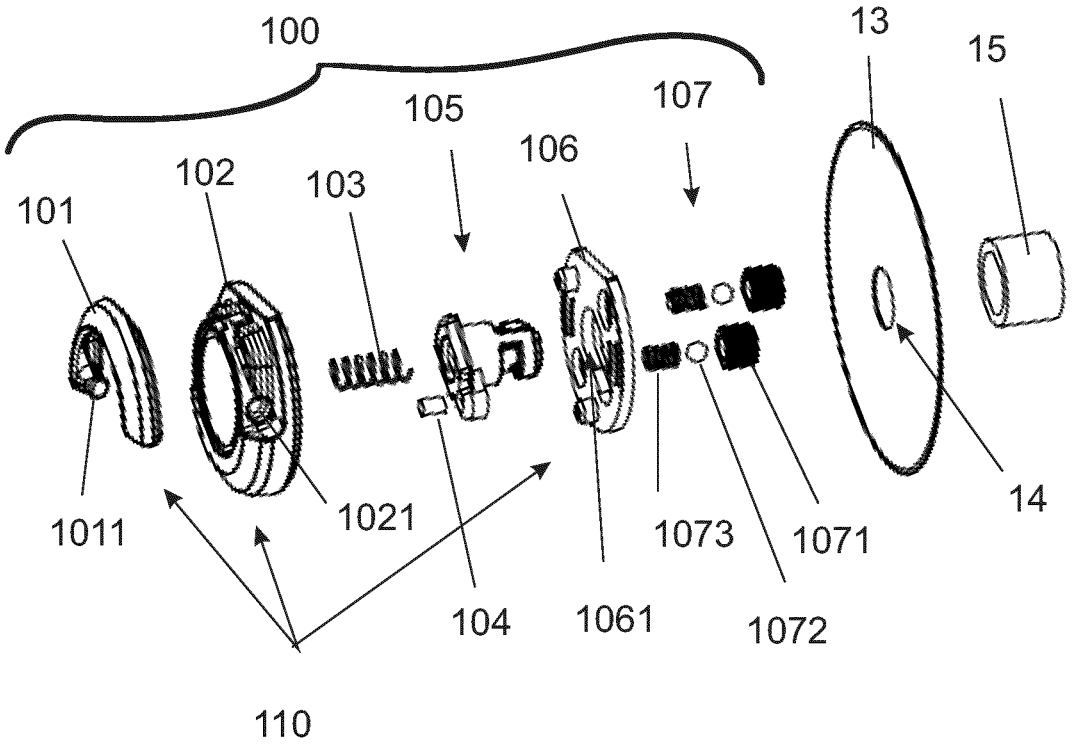
FIG. 2 illustrates an exploded view of a rotary blade replacement assembly according to an embodiment.
Figure 3:
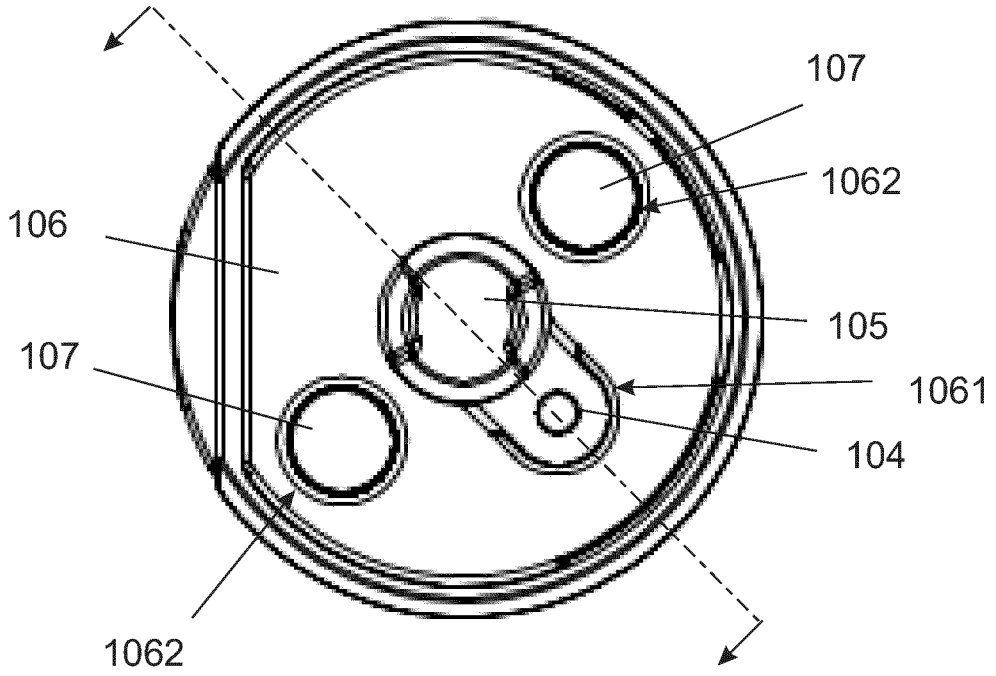
FIG. 3 illustrates a bottom view of a rotary blade replacement assembly.
Figure 4:
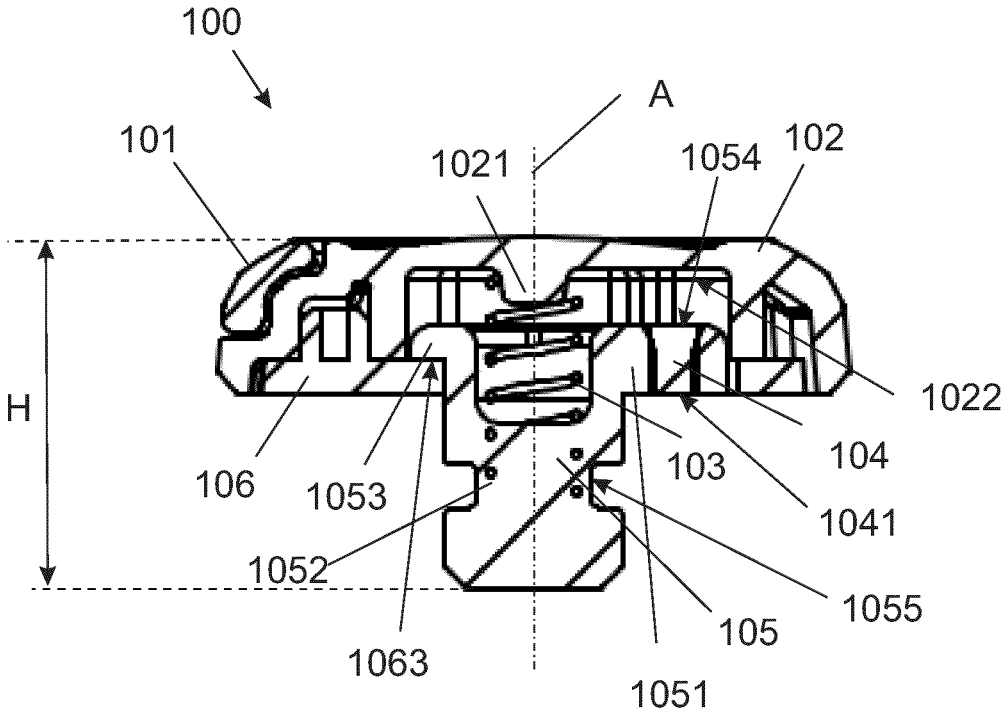
FIG. 4 illustrates a cross-sectional view of the rotary blade replacement assembly.

FIG. 2 illustrates an exploded view of a blade replacement assembly 100 according to an embodiment. FIG. 3 illustrates a bottom view of a rotary blade replacement assembly 100. FIG. 4 illustrates a cross-sectional view (dotted line of FIG. 3) of the rotary blade replacement assembly 100. The blade receiver assembly 100 comprises a switch 110, wherein the switch 110 comprises a switch cover 102 and a switch base 106 which are fixedly connected to each other. The fixed connection may be realised by an adhesive or a mechanical fastener.

The switch cover 102 is designed for the user's fingers to hold onto, and forms an inner space with the switch base 106. In the accompanying Figures, the switch cover 102 comprises a flip-up mechanism having a flippable arc 101, wherein both ends of the arc 101 have an inner protrusion 1011 facing each other and configured to fit and rotate inside a hole 1021 of the switch cover 102. The holes 1021 are arranged on both sides of the switch cover 102. During the use, the user may flip the arc 101 closer to the switch cover 102 which will improve line-of-sight to the rotary blade's 13 cutting edge by decreasing an overall height H of the blade replacement assembly 100. During the blade replacement operation, the user may flip the arc 101 away from the switch cover 102 which will provide a better grip for the fingers. The arc 101 can have a smooth or angular curve.

The switch cover 102 may alternatively be designed as a protruded flange or a knob or any other practical and/or aesthetic design having an inner space. The switch base 106 can be designed as a plate to close the other side of the switch cover 102. The inner space of the switch 110 is designed to hold at least partially an axle 105 within.

The switch base 106 has an opening 1061 allowing the axle 105 to move through the opening 1061. The opening 1061 can be shaped as oval, but other shapes are also applicable. The switch cover 102 and the switch base 106 may be manufactured of glass filled nylon or other suitable material comprising polymer. The axle 105 may be manufactured of steel material for its high durability.

The axle 105 comprises a structural section 1051 and a body receiver section 1052, wherein the structural section 1051 is provided at least partially within the switch 110, and the body receiver section 1052 is releasably connectable to a lock portion 15 in the blade assembly holding member 12. The body receiver section 1052 is dimensioned to pass through the perforation 14 of the rotary blade 13. The body receiver section 1052 of the axle 105 is arranged to be outside of the switch 110, wherein the rotary blade 13 is arranged to fit and rotate between the body receiver section 1052 and the switch base 106.

A spring 103 is arranged inside the switch 110 and connected to the axle 105 allowing the axle 105 to move along an axis A against spring force or elastic deformation. The spring 103 in this context may refer to a coil spring or any other elastic material capable of storing mechanical energy, such as foam or rubber. The spring force prevents an end surface 1054 of the axle 105 to move towards the switch cover 102 and contacting an inner surface 1022 of the switch cover 102.

The spring-loaded axle 105 may further comprise a magnet 104 incorporated or embedded in the structural section 1051 of the axle 105 by, for instance, adhesive, welding or mechanically. The magnet 104 may refer to any permanent magnet to produce a magnetic field, such as neodymium iron boron (NdFeB), samarium cobalt (SmCo), alnico and ceramic or ferrite magnets. The magnet 104 may be incorporated or embedded in the structural section of the axle 105 in such way that one surface 1041 of the magnet 104 may be exposed from the opening 1061 of the switch base 106. The magnet 104 may be arranged at a distance away from the axis A of the axle 105 and the surface 1041 of the magnet 104 may be at the same plane as the switch cover base 106 when the spring 103 is not in a compressed position. In some embodiments, two or more magnets 104 can be incorporated in the structural section 1051 on both sides of the axis A to obtain stronger magnetic force.

In the embodiment illustrated in the FIGS. 2-4, the structural section 1051 with the magnet 104 has bigger diameter than the body receiver section 1052 so that the magnet is not obstructed by the body receiver section 1052. The spring 103 may be arranged partially inside the axle 105 to facilitate keeping the spring 103 in place. In another embodiment, the spring 103 may partially surround the axle 105, wherein an end of the axle 105 closest to the switch is designed to fit inside the spring 103.

The rotary blade 13 may be rotatably arranged on the axle 105 between the magnet 104 and the body receiver section 1052, wherein the magnetic force attracts and prevents the rotary blade 13 from sliding off the axle 105. The magnetic force of the magnet 104 is also utilized during a rotary blade attachment operation. When the new rotary blade lies in the cartridge, the switch 110 with the axle 105 is moved closer so the body receiver section 1052 passes through the perforation 14 of the rotary blade 13, and with the magnetic force, the rotary blade 13 will be attracted to the magnet 104 without the user needing to touch the rotary blade 13 at all.

During the detachment operation of the rotary blade 13, the axle 105 is arranged to slide in relation to the switch base 106 when the spring 103 of the spring-loaded axle 105 is compressed, wherein a distance between the magnet 104 and the rotary blade 13 increases and the magnetic force weakens causing the rotary blade 13 to slide off the axle 105.

The switch 110 may be rotatable around the axis A of the axle 105, or slidable along the axis A of the axle 105, or both, when connecting to the blade assembly holding member 12 depending on the arrangement of the blade assembly holding member 12 and the body receiver section 1052. In the accompanying Figures, the body receiver section 1052 is illustrated comprising a rotatable twist-lock mechanism 1055 arranged to lock onto the lock portion 15 of the blade assembly holding member 12 in one position, and releasably slide in/out the blade assembly holding member 12 in another position. The twist-lock mechanism 1055 may be grooves on the body receiver section 1052, which are arranged to connect and secure the axle 105 into the lock portion 15 in the blade assembly holding member 12 in a locked position. The axle 105 is released from the lock portion 15 by rotating the switch 110. However, other known locking mechanisms may also be implemented.

The blade receiver assembly 100 may further comprise a bearing assembly 107, wherein the switch base comprises a corresponding bearing assembly opening 1062 for said bearing assembly 107. The bearing assembly 107 may comprise a casing 1071, a ball bearing 1072 and a bearing spring 1073, or any other known bearing solution. In the following Figures, the bearing assembly 107 is arranged in the bearing assembly opening 1062 in such way that the ball bearing 1072 partially protrudes from the switch case 106. When the blade receiver assembly 100 is connected to the rotary blade 13 and the body 10, the surface of the rotary blade 13 towards the switch 110 is in contact only with the ball bearing 1072 due to the magnetic force, but the rotary blade 13 does not touch the switch base 106 or the magnet 104. This allows friction between the switch 110 and the rotary blade 13 to be minimalized, which adds stability and smoothness for the user during the use. For a stable rotation of the blade 13, preferably two bearing assemblies 107 are arranged on both sides of the axle 105 having a same distance from the axis A of the axle 105.

The switch cover 102 may comprise a step 1021 protruding from an inner surface of the switch cover 102 and supporting the spring 103, wherein the spring 103 surrounds the step 1021, and allowing the axle 105 to slide along its axis A towards the step 1021, when the spring 103 of the spring-loaded axle 105 is compressed and supported by the inner surface of the switch cover 102. In another embodiment, where the spring 103 partially surrounds the end of axle 105, the switch cover 102 may comprise a cavity allowing the end of the axle to slide into the cavity while the inner surface 1022 of the switch cover 102 supports the spring 103.

The axle 105 may comprise a flange 1053 at the structural section 1051 to prevent the axle 105 from falling off the switch 110. The flange 1053 may be supported against an inner rim 1063 of the opening 1061 of the switch base 106. Due to the spring force, the flange 1053 contacts the inner rim 1063 unless the switch 110 is pressed against the spring force, wherein the structural section 1051 slides inside the inner space of the switch 110 and the flange 1053 disconnects with the inner rim 1063 of the switch base 106.

The following is a suggestion how to replace a dull rotary blade with a new one using the above-described embodiment.

1) The user flips the arc 101 away from the switch 110 to hold onto the arc 101, then rotates and optionally presses the switch 110, which rotates the spring-loaded axle 105. The body receiver section 1052 of the axle 105 comprising the twist-lock can now slide from the blade assembly holding member 100 causing the blade receiver assembly 100 to be disengaged from the body 10.

2) The blade receiver assembly 100 can now be slid off, and the dull rotary blade 13 moves with the blade receiver assembly 100 because of the magnetic force caused by the magnet 104 incorporated in the axle 105.

3) The switch 110 is pushed against a horizontal surface, for example an inner surface of the cartridge for disposed blades provided with a rotary blade package, wherein the axle 105 slides towards the inner space of the switch cover 102 against the spring force. This causes the magnetic force between the magnet 104 and the rotary blade 13 to weaken as the switch base 106 supports the rotary blade 13, which results the dull rotary blade 13 to be released from the axle 105, when the magnetic force is too weak to attract the rotary blade 13. This does not require the user to touch the rotary blade 13 at all.

4) The blade receiver assembly 100 can now engage with the new rotary blade 13 by sliding the axle 105 through the perforation 14 of the new rotary blade 13. The cartridge holding the new rotary blade 13 has preferably a cup-like depression aligned with the perforation 14 of the blade 13 to raise the new rotary blade 13 close enough for the magnetic force to attract the blade 13 and keep the blade 13 attracted towards the switch base 106. This step does not require the user to touch the rotary blade 13 either.

5) The blade receiver assembly 100 with the new blade 13 is now ready to be mounted on the body 10. The body receiver section 1052 of the axle 105 is aligned with the lock portion 15 of the blade assembly receiver member 12 and securely locked by rotating the switch 110 to the initial position. The rotary blade 13 is now replaced, and the user can flip the arc 101 back towards the switch 110. The cutting device with the new blade 13 is ready to be utilized.

It is to be understood that the above description and the accompanying figures are only intended to teach the best way known to the inventors to make and use the invention. It will be apparent to a person skilled in the art that the inventive concept can be implemented in various ways. The above-described embodiments may thus be modified or varied, without departing from the invention, as appreciated by those skilled in the art in the light of the above teachings. It is therefore to be understood that the invention and its embodiments are not limited to the examples described above but may vary withing the scope of the claims.

The invention claimed is:

1. A blade receiver assembly, comprising:

a switch comprising a switch cover and a switch base connected to each other forming an inner space, wherein the switch base comprises an opening;

a flippable arc pivotally coupled to the switch cover;

an axle, having an axis, and comprising a structural section and a body receiver section, wherein the structural section is provided at least partially within the switch and the body receiver section is provided outside the switch;

a spring provided inside the inner space of the switch;

and a magnet is incorporated in the structural section of the axle, wherein the magnet is arranged at a distance away from the axis of the axle;

wherein the axle is movable against a spring force of the spring through the opening of the switch base in relation to the switch, the spring force biases away an end surface of the axle facing toward the switch cover from contacting an inner surface of the switch cover.

2. The blade receiver assembly according to claim 1, wherein the spring is connected to the axle allowing the axle to move along an axis of the axle against the spring force.

3. The blade receiver assembly according to claim 1, wherein the structural section has a bigger diameter than the body receiver section.

4. The blade receiver assembly according to claim 1, wherein the blade receiver assembly further comprises a bearing, and the switch base comprises a corresponding an opening for said bearing.

5. The blade receiver assembly according to claim 1, wherein the body receiver section comprises a twist-lock.

6. The blade receiver assembly according to claim 1, wherein the switch cover comprises a step supporting the spring, wherein the spring surrounds the step.

7. The blade receiver assembly according to claim 1, wherein the axle comprises a flange at the structural section to prevent the axle from falling off the switch.

8. The cutting device according to claim 1, wherein the flippable arc comprises inner protrusions configured to fit and rotate inside holes in the switch cover.

9. A cutting device, comprising:

a body comprising a handle and a blade assembly holding member;

a rotary blade;

a blade receiver assembly, the blade receiver assembly comprising:

a switch comprising a switch cover and a switch base connected to each other forming an inner space, wherein the switch base has an opening;

a flippable arc pivotally coupled to the switch cover;

an axle with a structural section and a body receiver section and having an axis, wherein the structural section is provided at least partially within the switch and the body receiver section is provided outside the switch, a spring provided inside the inner space of the switch;

and a magnet is incorporated in the structural section of the axle, wherein the magnet is arranged at a distance away from the axis of the axle;

the axle is movable against a spring force of the spring through the opening of the switch base, the spring force biases away an end surface of the axle facing toward the switch cover from contacting an inner surface of the switch cover, and the body receiver section is releasably connectable to the blade assembly holding member.

10. The cutting device according to claim 9, wherein the rotary blade is arranged to fit and rotate between the body receiver section and the switch base.

11. The cutting device according to claim 9, wherein the spring is connected to the axle and arranged partially inside the axle.

12. The cutting device according to claim 9, wherein the spring is connected to the axle and arranged to partially surround the axle.

13. The cutting device according to claim 9, wherein a surface of the magnet is at the same plane as the switch base when the spring connected to the axle is not in a compressed position.

14. The cutting device according to claim 9, wherein the rotary blade is rotatably arranged on the axle between the magnet and the body receiver section, wherein the magnetic force attracts and prevents the rotary blade from sliding off the axle.

15. The cutting device according to claim 9, wherein the axle is arranged to slide along its axis, when the spring connected to the axle is compressed allowing a distance between the magnet and the rotary blade to increase and the magnetic force to weaken.

16. The cutting device according to claim 9, wherein the switch is rotatable, and the body receiver section comprises a twist-lock arranged to lock onto the blade assembly holding member in one position, and releasably slide in/out the blade assembly holding member in another position.

17. The cutting device according to claim 9, wherein the switch cover comprises a step supporting the spring.

18. The cutting device according to claim 9, wherein the structural section comprises a flange arranged to prevent the axle from falling off the switch.

19. The cutting device according to claim 9, wherein the flippable arc defines a smooth curve.

20. The cutting device according to claim 9, wherein the flippable arc defines an angular curve.

* * * * *